US005312197A

United States Patent [19]

Abramson

[11] Patent Number: 5,312,197

[45] Date of Patent: May 17, 1994

[54] INTER-DIGITAL SURGICAL SCRUB BRUSH FOR REDUCING SKIN TRAUMA

[76] Inventor: Daniel J. Abramson, 7671 San Mateo Dr., East, Boca Raton, Fla. 33433

[21] Appl. No.: 66,501

[22] Filed: May 24, 1993

[51] Int. Cl.[5] ..... A46B 5/02; A46B 9/02; A46B 11/00

[52] U.S. Cl. ..... 401/6; 401/11; 401/25; 401/27; 401/139; 15/105; 15/114; 15/160; 15/167.3; 15/210.1; 15/244.1

[58] Field of Search ..... 15/104.92, 104.93, 104.94, 15/105-107, 110, 111, 113, 114, 118, 160, 167.3, 210.1, 244.1, 244.4; 401/6, 9, 11, 23, 24, 25, 27, 28, 34, 139; 118/264, 270; 132/313, 317, 320; D4/114, 119, 137; 132/76.4; D32/40, 42, 45

[56] References Cited

U.S. PATENT DOCUMENTS

| | | | |
|---|---|---|---|
| D. 236,564 | 9/1975 | Kaufman | D32/40 X |
| 2,841,811 | 7/1958 | Carroll | 118/270 X |
| 3,066,346 | 12/1962 | Hofstra et al. | 15/105 X |
| 3,080,687 | 3/1963 | Gross | 15/118 |
| 3,317,944 | 5/1967 | Napier, Sr. et al. | 15/244.1 |
| 3,387,313 | 6/1968 | Smith et al. | 132/313 X |
| 3,467,978 | 9/1969 | Golden | 15/114 X |
| 3,556,667 | 1/1971 | Kaufman | 401/28 |
| 3,611,468 | 10/1971 | Michael | 15/104.93 |
| 3,707,012 | 12/1972 | Lane | 15/104.93 |
| 3,966,335 | 6/1976 | Abramson | 15/114 X |
| 4,479,277 | 10/1984 | Gilman et al. | 15/114 X |
| 4,480,351 | 11/1984 | Koffler | 15/106 X |
| 4,757,571 | 7/1988 | Young | 15/106 X |
| 5,213,430 | 5/1993 | Pandola | 401/139 X |

*Primary Examiner*—Philip H. Coe
*Assistant Examiner*—Charles Cooley
*Attorney, Agent, or Firm*—Malin, Haley, DiMaggio & Crosby

[57] ABSTRACT

An improved surgical scrub brush for providing an aseptic skin condition for surgeons and other hospital personnel who participate in surgery. The scrub brush provides for the simultaneous and expeditious aseptic cleansing of the digital, inter-digital, and web areas of the hand as well as the forearm, while at the same time reducing or eliminating skin abrasion and trauma brought about by numerous scrubbings. The scrub brush includes a soft cleansing pad having channels that allow for simultaneous use so that the user can select either bristles or the soft cleansing pad to reduce skin trauma. Additionally, the brush includes an attached fingernail cleaner and reservoir for dispensing antiseptic soap or skin conditioners.

1 Claim, 2 Drawing Sheets

INTER-DIGITAL SURGICAL SCRUB BRUSH FOR REDUCING SKIN TRAUMA

BACKGROUND OF THE INVENTION

1. Field of the Invention

This invention relates to an improved multiple digit surgical scrub brush for the hands and forearms, and specifically, to a multiple digit surgical scrub brush that includes a bristle surface configuration for simultaneous inter-digital and web space scrubbing, and a much softer foam surface configuration that provides for simultaneous digital scrubbing that reduces trauma to the skin surface. The scrub brush includes one or more containers attached to the brush containing sterile skin protective agents and antiseptics to be used during and after the scrub. It also contains a plastic nail cleaner.

2. Description of the Prior Art

The thorough scrubbing of hands and arms by surgical personnel, especially doctors, nurses, and other surgical room technicians, is standard procedure to insure an aseptic environment in the operating room. The use of individual scrub brushes for the hands and nails during the scrub process is well known by each member of the surgical team. Although it is imperative and absolutely essential that the scrubbing process for surgical personnel produce complete aseptic results on the surgical personnel's skin, oftentimes surgeons are faced with emergencies that do require immediate action so that the scrubbing process must be done both hurriedly and completely. The primary objective is to aseptically clean the forearms, hands and nails, and in particular, the inter-digital areas and web areas of each hand in conjunction with the nails. After scrubbing, surgical personnel are required to don latex gloves during surgical operations to protect the operating personnel and the patient from transmission, by tear, needle prick or other injury, of bacteria or virus from patient to surgical personnel or vice versa.

U.S. Pat. No. 3,966,335 issued to the Applicant Jun. 29, 1976 for a multi-digital surgical scrub brush addressed the problem of expeditiously scrubbing digital and web areas of the hands while insuring thorough cleanliness. One problem not addressed was the fact that most surgical personnel, especially surgeons, participate in several daily operations that, with continued and prolonged scrubbing with hard brush bristles, result in abrasion to the skin and especially the forearms, hands, and digital areas. This, over a period of years, leads to atrophic skin changes. The present invention addresses these problems of thorough cleaning, particularly using a scrubbing device used for inter-digital and web areas. Equally important, the invention provides a means for reducing the traumatic effects of the scrub by producing a single or multiple chamber dispenser of antiseptic chemicals for cleaning and asepsis, as well as various compositions for skin conditioning and skin protection. Also, the brush in accordance with the invention includes a nail cleaner for expeditious use without employing additional cleaning implements.

The present invention would typically be sold in a sterile plastic bag with the disposable brush being bathed in antiseptic emollient for one-time use. The scrub brush allows a surgeon to thoroughly and expeditiously scrub the inter-digital and web areas of each hand and forearm to an aseptic condition before surgery, while at the same time reducing skin trauma.

SUMMARY OF THE INVENTION

A scrub brush for cleaning a human hand, particularly, the digits and inter-digital skin areas, including web areas, that allows a person to thoroughly but expeditiously cleanse his hands without abrasion and resulting skin trauma. The surgical brush is comprised of a flat planar support member, substantially rectangular, having a plurality of somewhat rigid bristles orthogonally attached to one side of said rigid planar member. The bristles are arranged to cover the entire surface area of one side of said rigid, planar support member. The bristles are approximately longer than ½". The bristles may be made of artificial or natural fibers that are rigid and as conventionally used in hand brushes. The bristle top surface configuration has four parallel semi-cylindrical indentations or channels formed by the top surface of the bristles and each spaced apart by a raised portion having a flat top. Each channel is sized in depth and radius to be substantially semi-cylindrical in its configuration and can receive one-half surface of a human hand finger. The four parallel channels allow for simultaneous disposition of human fingers of one hand engaging the top surfaces of the bristles in the four channels so that one side of the fingers can be scrubbed simultaneously on one hand. The raised flat bristle portions disposed between each of the four channels are of sufficient height above each channel to engage the inter-digital and web areas of the hands between the fingers on both sides of the fingers for cleansing purposes. Thus, the bristles are configured so that the brush can be used to scrub both sides of the fingers on a hand and scrub the inter-digital areas and other parts of the wrist and forearms.

On the opposite side of the rigid flat support member is attached a soft foam or foam-like pad that also includes four parallel finger receiving channels, each of which receives a different finger and each of which is sized to receive half of the finger. The foam channels include sufficient spacing between projected portions of the foam pad to allow intersection with the inter-digital areas and web areas between the fingers of the hand. The top portions of the foam pad are flat and extends above the channels, separating each of the channels. The foam pad may be made out of foam rubber or foam plastic and is essentially soft when moist. The purpose of using this material is to allow cleansing of both the skin and hand surface without excessive trauma to the skin occasioned by constant scrubbing or brushing as would occur with the bristle side only.

Thus, a person using the brush can either use the bristles or the soft foam pad to accomplish cleansing of the fingers, hand, and wrist areas, using either side of the brush, depending on the particular skin condition of the user. Obviously, the bristles will provide for intense frictional scrubbing action and under certain occasions, may be necessary to use only the bristles. However, the user can switch between the bristles and the soft pad to accomplish aseptic cleansing of the hands to reduce skin trauma.

The improved brush may be marketed in a plastic, sterile, aseptic bag container including a skin protective agent such as aloe vera. The bag may be hermetically sealed until it is ready for use. The brush is envisioned as a disposable (one time use) that, once the plastic package is opened, will be used and then safely disposed. Therefore, the foam pad, bristles, and entire support member are aseptically prepared at the time of manufacture. The entire brush is then sealed within the plastic bag container free of contaminants.

The device also includes one or more individual pliable containers attached to the side of the brush that hold compositions that can be used for aseptic soap such as septisol, hexachlorophene, or others, skin conditioning such as aloe vera, vitamin A or D, and skin enhancement, such as collagen for treating skin that is rough or chafed. All these ingredients may be dispensed in a single container or in separate, individual containers. Each container has a cap, its own aperture and nozzle-like dispenser and is attached to the brush either by adhesive, velcro, or a specially adapted groove or slot fitted to the brush. Each particular composition is loaded into the chamber when the brush is manufactured and all of the compositions are aseptic. To dispense a particular composition from a container, the container cap is removed, the container may be compressed, forcing the particular liquid out the nozzle. The container may be made out of a flexible plastic that is clear to show the contents therein.

The brush also includes a nail cleaner that is removeably mounted in a slot between the container and the brush bristles. This allows for using a single implement for the complete cleansing of the hands, fingers, web areas, and the nail areas of the user without having to use additional cleansing implements.

By using the present invention, a person such as a surgeon who might perform several operations a day and requires numerous cleansings can greatly reduce the skin trauma over the years caused by using rough bristles on a brush each time the surgeon scrubs up for an operation. By using the soft pad as an alternate during various stages of the scrub-up, skin abrasion trauma is greatly reduced. Further, by providing skin conditioners in addition to aseptic soap, the condition of the skin can be greatly enhanced throughout the scrubbing process.

It is an object of this invention to provide an improved scrub brush for cleansing simultaneously and expeditiously the hand and digital areas and inter-digital areas of the hands while reducing skin trauma.

It is another object of this invention to provide an improved scrub brush that provides for a soft cleansing pad in addition to bristles for reducing skin trauma during scrubbing.

And yet another important object of this invention is to provide an improved scrub brush that allows for dispensing of skin conditioners in conjunction with a soft cleansing pad to reduce skin trauma.

And yet another object of this invention is to provide an improved scrub brush that includes a nail cleaner in conjunction with a configured soft pad and brush with configured bristles.

In accordance with these and other objects which will be apparent hereinafter, the instant invention will now become described with particular reference to the accompanying drawings.

DESCRIPTION OF THE PREFERRED EMBODIMENT

Figure 1:
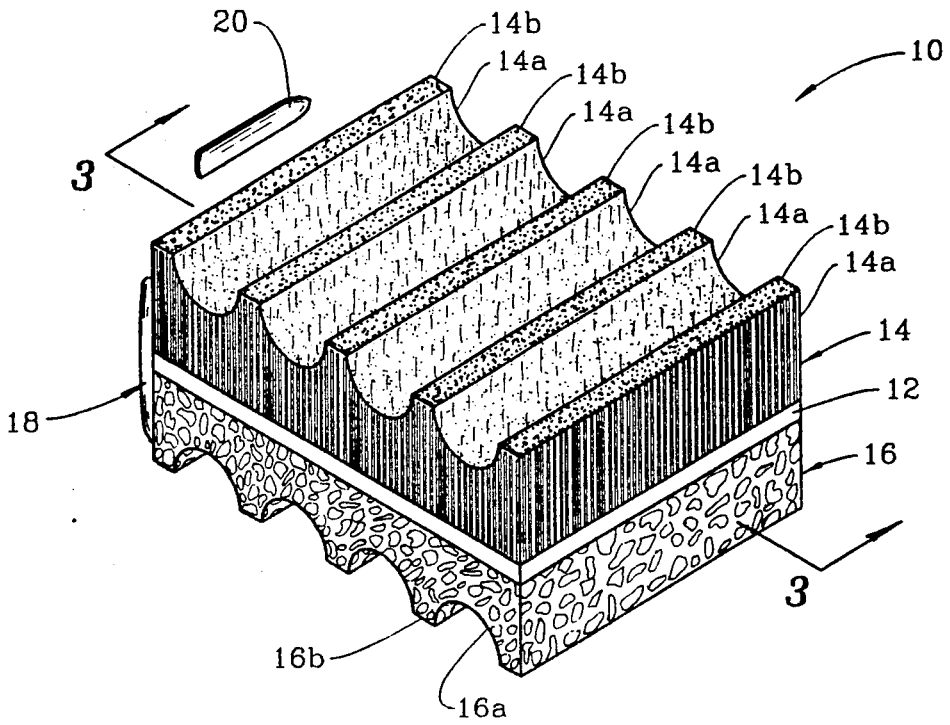
FIG. 1 shows a perspective view of the present invention.

Referring now to the drawings, and in particular, to FIG. 1, the present invention is shown generally at 10, comprised of a rigid, flat, planar support member 12 that is rectangularly shaped and sized to be hand-held, having attached on the upper first side a plurality of bristles 14 of varying length. The bristles 14 are greater than or equal to ½" and include a top surface configuration of four channels longitudinally parallel 14a disposed from one side to the other. The bristles 14, and in particular, the four channels 14a, are separated by raised flat portions 14b comprised of the longest of the bristles that provide a raised wall-like structure between channels 14a that is used to scrub the inter-digital or web areas of the hands of the user during scrubbing while the four fingers are mounted within the four channels. The raised areas 14b can also be used for scrubbing other parts of the hand, the wrist and forearm areas. The width of the spacing of each raised portion 14b is sufficient to engage across the typical web area of a human hand between the fingers.

The brush 10 also includes a soft foam cleansing pad 16 attached firmly by adhesive or other means to the lower bottom surface of support member 12. The foam pad 16 may be made of foam rubber or foam plastic, but is essentially soft and resilient when compared with the rigidity of the brush structure 14. The foam pad 16 is also sized to encompass the complete bottom area of support member 12 and includes four longitudinal channels sized almost identically to the bristle channels 14a and parallel so that four fingers can be placed simultaneously in the channel 16a for cleansing the finger areas. The foam pad channels 16a are also separated by raised wall portions having flat upper surface areas that are sized at least ¼" from side-to-side between channels to provide a sufficient upper flat surface area that also will engage the web portions between the fingers of a human hand for thorough cleansing. The flat portions of the raised portion 16b on the pad may also be used for cleansing other areas of the hand and forearm through the rubbing of the foam pad against the skin surface. Soap can impregnate the foam pad. By using a resilient, soft foam pad 16, the chafing and harsh rubbing normally associated with bristles 14 can be greatly reduced or eliminated by the soft surface provided by the foam pad 16. The foam pad can be made of foam rubber, foam polystyrene, or of a plastic, rubber, or cellulose having a sponge-like softness.

The scrub brush 10 also includes an independent liquid receiving chamber 18 mounted on one side of the brush and connected firmly to the edge of one side of the support member 12. As an alternative, the chamber can be mounted on any of the fixed edges. A nail cleaner 20 is also removably mounted in a small space provided on one side of the support member 12 adjacent the independent chamber 18.

Figure 2:
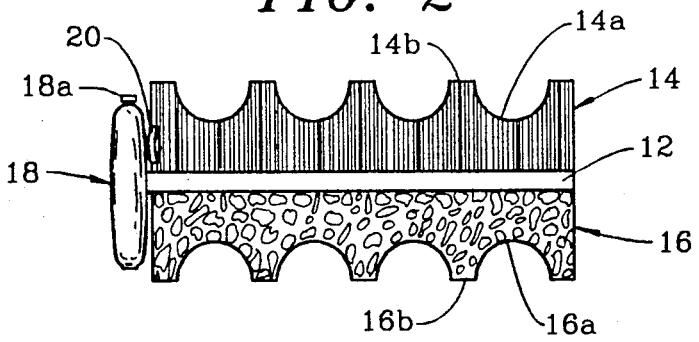
FIG. 2 shows a front elevational view of the present invention.

FIG. 2 shows the independent chamber 18 that includes cap 18a over a dispensing aperture located at the top of the chamber. FIG. 2 also shows the configuration of the bristle channels 14a and the foam pad channels 16a which are the same in radius, each of which is approximately the radius of a human finger to allow a snug fit of the human fingers in the channels simultaneously. FIG. 2 also shows the projection of the nail cleaner 20 along one side of the device. The nail cleaner 20 is mounted in a small space on the support member 12 out of the way until removed for use.

Figure 3:
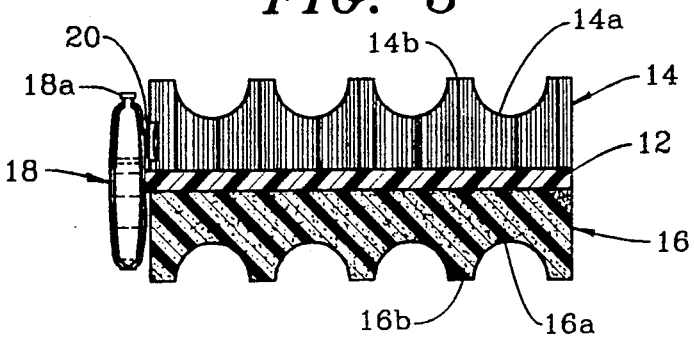
FIG. 3 shows a front cross sectional view of the present invention through line 3—3 of FIG. 1.

FIG. 3 shows the brush with a rigid cross section of support member 12 which is flat on both sides and having the brush bristles 14 firmly attached thereto orthogonally. The chamber 18 is shown made of a flexible plastic, containing liquid compositions such as an antiseptic soap and skin conditioners such as aloe vera, vitamins A and D, and collagen mixed together. The flexible chamber wall is such to allow compression manually by depressing the chamber 18, forcing liquid to exit the chamber through an aperture when cap 18*a* is removed.

Figure 4:
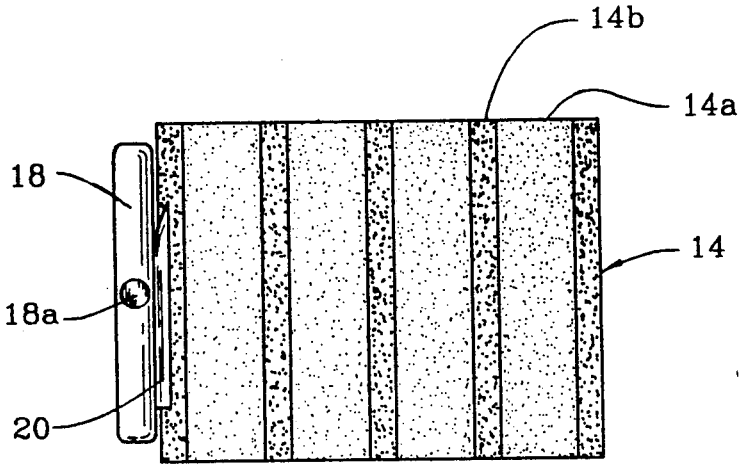
FIG. 4 shows a top plan view of the present invention.

FIG. 4 shows a top view of the brush and the bristles and clearly delineates the chamber which contains different liquids for use by the user during the scrubbing and cleaning operation. In particular, chamber 18 may contain an antiseptic soap used for cleaning purposes, skin conditioner or skin balm such as aloe or vitamins A and D after the scrub to anoint the hands, fingers and forearms to minimize skin damage, and other skin protectants or conditioners such as collagen used after the scrub to enhance the condition of the hands and forearms.

FIG. 4 shows the nail cleaner 20 as mounted and spaced between the bristles 14 and chamber 18 and which can be manually removed.

Figure 5:
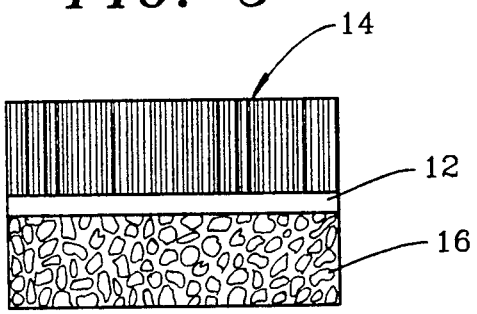
FIG. 5 shows a side elevational view of the present invention.

FIG. 5 shows a side elevational view of the invention.

Figure 6:
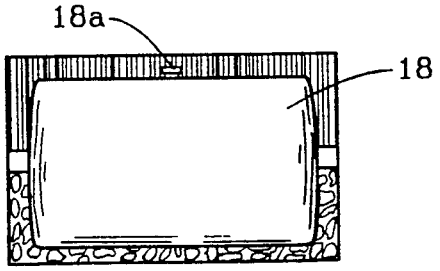
FIG. 6 shows a side elevational view of the present invention opposite that shown in FIG. 5.

FIG. 6 shows the chamber 18 which may be transparent to show the liquid level that includes the antiseptic emollient aloe and collagen. Note that the entire chamber 18 is rigidly affixed to the end of the rigid support member 12 on one side of the brush and is out of the way during scrubbing action.

In operation, the nail cleaner 20 is initially used. Next, the user will grasp the brush and select whether to cleanse and scrub with the bristle side or the foam rubber or foam plastic pad. Either side can be used interchangeably to expedite scrubbing all four fingers may be treated simultaneously. At the initial cleansing, chamber 18 would be selected to provide the aseptic soap for cleansing action. After the scrub is completed, chamber 18 is again depressed for aloe skin treatment, or for additional skin treatment with collagen.

Using the present scrub brush, a surgeon or other medical personnel who must scrub frequently, have the benefit of selecting a soft scrubbing surface when necessary to minimize skin trauma caused from constant scrubbing. In addition, the present invention provides enhancements for minimizing skin trauma for improving the skin condition to minimize skin damage. Thus, the present invention facilitates scrubbing while at the same time reducing skin trauma.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A scrub brush, especially useful for surgeons and other hospital personnel who participate in numerous surgical activities to permit simultaneous cleaning of the forearms, hands, fingers, and inter-digital areas on a hand to produce an aseptic condition on the skin of the person while reducing skin trauma, comprising:

a rigid, flat, thin support member, substantially hand sized and rectangular in shape, said support member having a first, planar surface and a second planar surface, said second planar surface disposed opposite said first planar surface;

a plurality of bristles orthogonally attached to said first planar surface, said bristles covering substantially the entire area of said first planar surface and having a plurality of semi-circular shallow parallel channels, substantially sized to accommodate at least four fingers of a human hand, wherein each of said four fingers may be positioned against the bristles and be simultaneously received in the channels, said bristles further including raised flat portions separating said channels for contacting the inter-digital and web areas of a human hand while the fingers are mounted in said channels;

a soft, resilient poly-foam hand and skin cleaning pad mounted on said second planar surface, said pad substantially covering the entire area of said second planar surface, said resilient pad including four semi-circular shallow parallel channels sized to simultaneously receive and contact the fingers of a human hand, said pad further including raised flat portions separating said finger receiving channels and having a height and width enabling contact with the inter-digital and web areas of a human hand while four fingers are simultaneously placed in said channels, said pad further being securely attached to said second planar surface, whereby one of said plurality of bristles and said pad can be selected for scrubbing the hand surfaces and the inter-digital areas to reduce trauma on the skin;

at least one transparent chamber removeably attached to an end of said support member, said chamber holding a skin protection composition for aiding in the reduction of skin trauma; and a removeably mounted fingernail cleaner oblong in shape mounted in a space on said support member for cleaning beneath a fingernail.

* * * * *